United States Patent [19]

Baset

[11] 4,332,676

[45] Jun. 1, 1982

[54] REMOVAL OF BASIC NITROGEN COMPOUNDS FROM ORGANIC STREAMS

[75] Inventor: Zeinab Baset, New Providence, N.J.

[73] Assignee: Exxon Research & Engineering Co., Florham Park, N.J.

[21] Appl. No.: 218,021

[22] Filed: Dec. 19, 1980

[51] Int. Cl.[3] ..... C10G 21/10

[52] U.S. Cl. ..... 208/254 R; 208/293

[58] Field of Search ..... 208/254 R, 293

[56] References Cited

U.S. PATENT DOCUMENTS

| | | | |
|---|---|---|---|
| 1,947,868 | 2/1934 | Morrell et al. | 208/293 |
| 2,079,782 | 5/1937 | Wells | 208/293 |
| 2,410,042 | 10/1946 | Bond | 208/293 |
| 2,754,248 | 7/1956 | Wetzel | 208/254 R |

FOREIGN PATENT DOCUMENTS

| | | | |
|---|---|---|---|
| 369785 | 3/1932 | United Kingdom | 208/254 R |

OTHER PUBLICATIONS

Voroshzov et al., "Ber. (Abstract)," 63B, pp. 2354–2362, (1930).

DeCarli, "Gass. Chim. Ital. (Abstract)," 57, pp. 347–355, (1927).

Zhurin et al., "Zh. Obshch. Khim. (Abstract)," 33(10), pp. 3360–3364 (1963).

Sharada et al., "Current Sci., India (Abstract)," 29, pp. 130–131, (1960).

Hata et al., "Nature (Abstract)," 203(4952), pp. 1378–1379, (1964).

*Primary Examiner*—John Doll

*Attorney, Agent, or Firm*—Henry E. Naylor

[57] ABSTRACT

Basic nitrogen compounds are removed from organic streams containing at least a stoichiometric amount of water but not so much water that would cause a two phase liquid system. The stream is contacted with the gaseous sulfur dioxide, thereby precipitating a salt comprising the basic nitrogen compound, sulfur dioxide, and water and thereafter separating the precipitated salt from the contacted stream. The basic nitrogen compounds and the sulfur dioxide can then be regenerated from the salt.

5 Claims, No Drawings

REMOVAL OF BASIC NITROGEN COMPOUNDS FROM ORGANIC STREAMS

BACKGROUND OF THE INVENTION

The present invention relates to a method for separating basic nitrogen compounds from organic streams with the use of gaseous sulfur dioxide.

It is generally considered undesirable to have basic nitrogen compounds present in various organic streams, particularly hydrocarbonaceous streams such as coal liquids, oil shale liquids and petroleum oils. These basic nitrogen compounds, even if present in very small quantities, have been attributed to creating aging problems in coal and oil shale liquids, acting as poisons or deactivants for catalysts in the cracking of crude oil, and being detrimental in oils used as lubricants, fuel oils, medicinal oils, etc.

Although various methods have been employed for separating basic nitrogen compounds from such organic liquids, there is still a need in the art for a more efficient separation method.

SUMMARY OF THE INVENTION

In accordance with the present invention there is provided a method for separating basic nitrogen compounds from an organic stream, the method comprising: (a) contacting said stream, at a temperature of about 20° C. to about 100° C. with at least one mol of gaseous sulfur dioxide per mol of basic nitrogen compound in the organic stream, thereby precipitating a salt comprising the basic nitrogen compound, sulfur dioxide, and water; and (b) separating the precipitated salt from the contacted stream. The organic stream treated in accordance with the present invention is one which contains at least a stoichiometric amount of water, based on (a) the total concentration of basic nitrogen compound in the organic stream, and (b) the amount of sulfur dioxide employed. In no event will the stream contain so much water as to form two liquid phases, that is, an aqueous phase and an organic phase.

In one preferred embodiment of the present invention the organic stream is selected from the group consisting of coal liquids, shale-oil, and petroleum oils.

In another preferred embodiment of the present invention the salt which has been separated is heated to its decomposition temperature thereby regenerating the basic nitrogen compounds, sulfur dioxide, and water. The sulfur dioxide can then be recycled for contacting the feed stream.

DETAILED DESCRIPTION OF THE INVENTION

Various types of basic nitrogen compound-containing organic streams are suitable for the practice of the present invention. Particularly suitable are those organic streams such as the hydrocarbonaceous streams selected from the group consisting of coal liquids, shale-oils, and petroleum oils. Also, coal bottoms, or heavy coal fractions, soluble in common organic solvents at reaction temperatures herein, may be treated in accordance with the present invention. It is critical that such streams contain at least a stoichiometric amount of water, before being treated by the presently claimed method; but in no event will they contain so much water as to cause the development of a 2 phase (aqueous and organic) system. The term, stoichiometric amount of water, as used herein means a stoichiometric amount of water based on the total concentration of basic nitrogen compounds in the organic stream and the amount of gaseous sulfur dioxide employed for contacting the stream.

Non-limiting examples of basic nitrogen compounds which can be separated from organic streams by the practice of the present invention include: heterocyclic nitrogen compounds such as quinoline, tetrahydroquinoline, pyridine, acridine and phenanthridine; aryl amines such as aniline, and aliphatic amines such as methyl amine, ethyl amine, and indoline.

The present invention is not dependent on the method employed for producing the basic nitrogen compound-containing stream. For example, any coal liquid containing such nitrogen compounds can be treated regardless of the method used for producing the coal liquid. Non-limiting examples of processes for producing coal liquids include pyrolysis, solvent refining, direct hydrogenation with or without a catalyst, catalytic and noncatalytic hydrogenation in the presence of a nonhydrogen donor solvent and catalytic and noncatalytic liquefaction by a hydrogen donor solvent method.

In accordance with the invention, the basic nitrogen compound-containing organic stream is first contacted with gaseous sulfur dioxide at atmospheric pressure and at a temperature from about room temperature (20° C.) to about 100° C. for an effect amount of time. The term, effective amount of time, as used herein, means at least that amount of time required to ensure substantially complete separation of the basic nitrogen compound in the form of a salt containing the basic nitrogen compound, sulfur dioxide, and water. By substantially complete separation is meant that at least 95 wt. % of the basic nitrogen compounds, which are capable of being removed from the stream at the temperature and concentration of sulfur dioxide employed, will be separated out of the stream by way of such salt formation. It will be noted that if higher temperatures are employed, higher pressures would have to be employed to ensure that the sulfur dioxide remain in solution and that the total amount of separation of basic nitrogen compounds from the stream will be decreased. Furthermore, the use of polar solvents or organic streams of a polar nature, will decrease the amount of basic nitrogen compound capable of being removed by the practice of the invention.

In the practice of this invention at least one mol of gaseous sulfur dioxide is employed for each mol of basic nitrogen compound present in the stream. preferably 1.5 mols of gaseous sulfur dioxide is employed per mol of basic nitrogen compound to ensure completion of reaction. Of course, greater amount of gaseous sulfur dioxide may be employed as desired and the excess recovered and recycled at completion of the reaction for most basic nitrogen compounds in most streams. The determination of the maximum amount of sulfur dioxide suitable for use can be determined by routine experimentation by one having ordinary skill in the art.

The amount and type of basic nitrogen compounds in any given organic stream can be determined by one having ordinary skill in the art employing conventional analytical methods and will not be discussed herein in further detail.

The resulting salt can then be separated from the contacted stream by an appropriate conventional separation method such as by centrifuging, filtering or decanting.

After the salt is separated from the contacted stream, it is preferred to regenerate the basic nitrogen compounds, the sulfur dioxide, and water. This regeneration can be accomplished by heating the resulting salt to its decomposition temperature (generally from about 70° C. to about 300° C.) and collecting the components.

The resulting salt can also be treated with an inorganic base, such as a caustic (e.g. sodium hydroxide) after which the basic nitrogen compounds can be collected with an organic solvent such as petroleum ether, benzene, or toluene. The caustic can, of course, be recycled until it is spent, thereafter it can be heated to generate sodium oxide and sulfur dioxide. The sulfur dioxide is preferably recycled.

It is preferred to heat the salt to its decomposition temperature and collect the components. In either case, the recovered sulfur dioxide is preferably recycled to the feed stream.

Depending on the temperature and pressure employed during the contacting step and the amount of basic nitrogen compounds initially separated, it may be desirable to contact the organic stream from a previous stage a multitude of times to effect substantially complete separation of basic nitrogen compounds from the organic stream. For example, after initial contact of the stream with gaseous sulfur dioxide, the treated stream is separated from the resulting salt and passed on to another stage for contact with additional gaseous sulfur dioxide. This sequence can be repeated as often as practical and desirable.

It is also within the scope of the present invention to employ a non-polar solvent during the contacting step. It must be kept in mind though that if such a solvent is employed the upper reaction temperature may be dependent on that particular solvent. Non-limiting examples of such solvents suitable for use herein include petroleum ether (a mixture of pentane and hexane/isomers), hexane, pentane, toluene, etc.

The following examples serve to more fully describe the present invention. It is understood that these examples in no way serve to limit the true scope of this invention, but rather, are presented for illustrative purposes.

EXAMPLE 1

Six solutions were prepared so that each was characterized by having 1 mol of a specific basic nitrogen compound, 3 mols of sulfur dioxide and 1 mol of water. Furthermore, each solution contained a predetermined amount of a specified solvent, representing an organic stream, so as to give a 10 wt. % of basic nitrogen compound in solvent, based on the total weight of basic nitrogen compound plus solvent. The specific basic nitrogen compounds and its organic stream, as well as the wt. % of basic nitrogen compound removed from the stream, is shown in Table I below.

Specifically, the solutions were prepared by first bubbling gaseous sulfur dioxide in water until the desired 3 mol concentration of sulfur dioxide was obtained per mol of water. A predetermined amount of basic nitrogen compound was then dissolved in the corresponding solvent to give a 10 wt. % solution of basic nitrogen compound in solvent. The solvent solution was treated with the appropriate amount of sulfur dioxide solution at 15° C. for one hour. The treated solution was then centrifuged for thirty minutes to remove the resulting salts. The original solution and the treated solution were analyzed by gas chromatography to determine the percentage of basic nitrogen compound removed, based on the total amount of basic nitrogen compound in the solution before treatment. The results are shown in Table I below.

TABLE I

| Solution # | N-Base | Solvent | % Removal of N Base |
|---|---|---|---|
| 1 | tetrahydroquinoline (THQ) | ether | 15 |
| 2 | tetrahydroquinoline | hexane/ether 1:1 | 100 |
| 3 | tetrahydroisoquinoline (THIQ) | hexane | 100 |
| 4 | tetrahydroisoquinoline | ether | 100 |
| 5 | isoquinoline (IQ) | hexane | 100 |
| 6 | quninoline (Q) | hexane | 98 |

This example illustrates the effectiveness of gaseous sulfur dioxide for removing basic nitrogen compounds from various organic streams. It also illustrates the effect of polar solvents on the removal of certain basic nitrogen compounds.

EXAMPLE 2

The procedure of Example 1 above was followed except the basic nitrogen compound employed was equal molar amounts of THQ and Q for solutions 1 to 3 and equal molar amounts of THIQ and IQ for solution 4. The concentration of basic nitrogen composition in solvent is shown in Table II below along with the % of basic nitrogen compound removed.

TABLE II

| Solution # | Wt. % of N-Base in Solvent | % N-Base Removal | |
|---|---|---|---|
| 1 | 20 wt. % in ether | 100 (Q) | 63 (THQ) |
| 2 | 10 wt. % in ether | 99 (Q) | 94 (THQ) |
| 3 | 10 wt. % in hexane | 100 (Q) | 97 (THQ) |
| 4 | 20 wt. % in ether | 100 (THIQ) | 100 (IQ) |

This example also illustrates the effectiveness of gaseous sulfur dioxide for removing basic nitrogen from various types of organic streams.

EXAMPLE 3

4.6 g of gaseous sulfur dioxide was bubbled into 1.5 g of distilled water. This aqueous solution was blended with a mixture of 11.35 g of coal liquid and 3.2 g of toluene wherein the coal liquid was obtained from a pyrolysis liquefaction process and contained 8.6 wt. % of basic nitrogen compounds, based on the total weight of the coal liquid. This mixture was allowed to sit for 30 minutes, at room temperature, whereupon it was centrifuged at 5° C. for 30 minutes to separate the resulting solid complex from the treated coal liquid. The liquid phase was decanted and analyzed for basic nitrogen compounds by conventional analytical techniques and was found to contain 1.43 wt. % of such basic nitrogen compounds, based on the total weight of the treated coal liquid.

EXAMPLE 4

5.5 g of gaseous sulfur dioxide was bubbled through 2.5 g of distilled water. This aqueous solution was blended, at room temperature, with 91 g of a shale-oil which contained 2.5 wt. % of basic nitrogen compounds based on the total weight of the shale-oil. The mixture was allowed to sit at room temperature for 30 minutes whereupon it was centrifuged for 30 minutes to separate the resulting solid complex from the treated shale-oil. The treated oil phase was decanted and was found to contain only 1.84 wt. % basic nitrogen compounds when analyzed by conventional analytical techniques.

What is claimed is:

1. A method for separating basic nitrogen compounds from an organic feed stream selected from the group consisting of coal liquids, oil-shale liquids, petroleum oils, and coal bottoms which are soluble in common organic solvents at temperatures from about 20° C. to about 100° C., wherein said stream contains at least a stoichiometric amount of water but not so much water that would cause two liquid phases, the method comprising:

(a) contacting said stream, at a temperature from about 20° C. to about 100° C. at about atmospheric pressure, with at least one mol of gaseous sulfur dioxide per mol of basic nitrogen compound in an organic stream, thereby precipitating a salt comprising the basic nitrogen compounds, sulfur dioxide and water; and (b) separating the precipitated salt from the contacted stream.

2. The method of claim 1 wherein the organic stream is selected from the group consisting of coal liquids, oil-shape liquids and petroleum oils.

3. The method of claim 1 or 2 wherein about 1.5 mols of sulfur dioxide is employed per mol of basic nitrogen compound.

4. The method of claim 1 or 2 wherein the precipitated salt is separated from the contacted stream by a method selected from the group consisting of centrifuging, filtering, and decanting.

5. The method of claim 1 or 2 wherein the separated precipitated salt is heated to its decomposition temperature, its components collected, and the sulfur dioxide component recycled to the feed stream.

* * * * *